US007145422B2

(12) United States Patent
Imanishi et al.

(10) Patent No.: US 7,145,422 B2
(45) Date of Patent: Dec. 5, 2006

(54) DC RELAY

(75) Inventors: Hiroyuki Imanishi, Osaka (JP); Akinobu Yoshimura, Osaka (JP); Takeshi Ariyoshi, Osaka (JP); Tamio Tsurita, Osaka (JP); Yasuhiko Nishi, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 28 days.

(21) Appl. No.: 10/531,067

(22) PCT Filed: Feb. 20, 2004

(86) PCT No.: PCT/JP2004/002032

§ 371 (c)(1),
(2), (4) Date: Apr. 12, 2005

(87) PCT Pub. No.: WO2004/075228

PCT Pub. Date: Sep. 2, 2004

(65) Prior Publication Data

US 2005/0285704 A1 Dec. 29, 2005

(30) Foreign Application Priority Data

Feb. 21, 2003 (JP) ..... 2003-045176
Mar. 24, 2003 (JP) ..... 2003-079841
Jul. 16, 2003 (JP) ..... 2003-275363

(51) Int. Cl.
*H01H 9/30* (2006.01)

(52) U.S. Cl. ..... 335/201; 335/132; 335/133

(58) Field of Classification Search ..... 335/106, 335/132, 133, 196, 201; 200/243
See application file for complete search history.

(56) References Cited

U.S. PATENT DOCUMENTS 2,506,991 A * 5/1950 Lowell ..... 218/23
3,090,854 A * 5/1963 Kretzschmar ..... 218/25
4,367,448 A * 1/1983 Nishizako ..... 335/201
4,404,443 A * 9/1983 Coynel et al. ..... 218/23
4,835,502 A * 5/1989 Minnette ..... 335/201
5,004,874 A * 4/1991 Theisen et al. ..... 218/151
5,546,061 A * 8/1996 Okabayashi et al. ..... 335/78
6,700,466 B1 * 3/2004 Yamamoto et al. ..... 335/132

FOREIGN PATENT DOCUMENTS

JP 18-1235 Y1 2/1943

(Continued)

*Primary Examiner*—Ramon M. Barrera
(74) *Attorney, Agent, or Firm*—McDermott Will & Emery LLP

(57) ABSTRACT

A direct current relay includes a plurality of contact pairs, and a plurality of magnets (5). Each of the plurality of contact pairs is configured having contacts (21, 22, 31) with contact regions (21*a*, 22*a*, 31*a*) disposed to allow opening and closure with respect to each other. The plurality of contact pairs are disposed such that the plurality of magnets (5) are disposed on one straight line, and the contact pairs are located between the magnets (5) on a line identical to the straight line. Each of the plurality of magnets (5) is provided to distort an arc generated between contacts (21, 22, 23, 31) on an occasion of relay cut off in a direction crossing the straight line. Even if a backward current flows, arcs will not interfere with each other, allowing extinguishing in a short time. Accordingly, a direct current relay can be obtained, capable of cutting off a high direct current voltage in a short time even on an occasion of backward current while minimizing the number of magnets and allowing down-sizing with a simple structure.

5 Claims, 6 Drawing Sheets

FOREIGN PATENT DOCUMENTS

| | | | |
|---|---|---|---|
| JP | 34-1429 | Y1 | 2/1959 |
| JP | 51-25704 | Y1 | 6/1978 |
| JP | 53-134078 | | 10/1978 |
| JP | 57-45745 | | 3/1982 |
| JP | 57-170417 | | 10/1982 |
| JP | 58-88763 | | 6/1983 |
| JP | 63-34178 | Y2 | 9/1988 |
| JP | 4-351823 | | 12/1992 |
| JP | 5-9623 | | 1/1993 |
| JP | 7-235248 | | 9/1995 |
| JP | 8-203368 | | 8/1996 |
| JP | 9-320411 | | 12/1997 |
| JP | 10-177821 | | 6/1998 |
| JP | 2001-179370 | | 6/2001 |
| JP | 2004-71512 | | 3/2004 |

* cited by examiner

DC RELAY

TECHNICAL FIELD

The present invention relates to a direct current relay. Particularly, the present invention relates to a direct current relay that can reliably cut off direct current by inhibiting interference between arcs generated at a plurality of pairs of contacts, when provided.

BACKGROUND ART

Recently, vehicles of high voltage (approximately 300V) such as hybrid vehicles and fuel-cell powered vehicles have been developed from the standpoint of environmental issues. Such vehicles include a control circuit constituted of a main battery of high direct current voltage and a high voltage circuit. In the case of an accident or the like, the battery must be disconnected from the control circuit since it corresponds to a high direct current voltage. To this end, a direct current relay formed of a mechanical contact is provided between the battery and the control circuit.

In such relays, the cut off speed is extremely low since the arc generated when the high direct current voltage is to be cut off is very large. It was extremely difficult to achieve cut off in a short time. In view of the foregoing, there is known a conventional structure of placing a magnet at the arc generating region to extend the arc by Lorentz force (for example, refer to Japanese Patent No. 3321963).

The direct current relay disclosed in Japanese Patent No. 3321963 includes two pairs of contacts, each contact pair being sandwiched by a pair of magnets arranged so as to be orthogonal to a line connecting the contact pairs. In this relay, the magnets forming a pair are arranged so that the opposite magnetic pole facing each other differ. These pairs of contacts have the contacts provided so that current flows in series when connected.

In accordance with Japanese Patent No. 3321963, the arc generated between the contacts, when each contact pair attains a non-contact state, is distorted to extend on the line connecting the two contact pairs and towards the side opposite to the adjacent contact pair (outer side).

The conventional relay disclosed in Japanese Patent No. 3321963 requires space to ensure sufficient arc extension for immediate relay cutoff since a pair of magnets are disposed corresponding to each contact pair, and the arc is extended outward of these contact pairs on a line connecting the two contact pairs through the action of the magnetic field.

The number of magnets is increased in order to dispose a pair of magnets for each contact pair having the attraction corresponding to the degree of arc extension. This poses the problem that the entire relay is increased in size.

Furthermore, the cost of the relay will become higher since the increased number of pairs of magnets, one pair disposed for each contact pair, will induce further time and effort in the assembly procedure.

Hybrid vehicles and the like employ a system to convert kinetic energy into electric energy to charge the battery at the time of deceleration. Therefore, a backward current (regenerative current) may be generated in the relay. The need arises for a relay to be cut off even in the case where a backward current flows excessively.

However, if the relay is cut off when a backward current is generated in accordance with the configuration of the relay disclosed in Japanese Patent No. 3321963, the arc occurring between the contacts will be distorted towards a region between the two contact pairs by the Lorentz force of the magnet. In this case, each arc will be extended towards an adjacent pair of contacts to be linked together, giving rise to the problem that immediate cutoff cannot be achieved.

Furthermore, superior welding resistance and temperature characteristic are required since the generated heat is great due to the high contact resistance of the contact unit.

DISCLOSURE OF THE INVENTION

An object of the present invention is to provide a direct current relay that can cut off a high direct current voltage in a short time even in the case of backward current while minimizing the number of magnets and allowing downsizing with a simple configuration.

The present invention is configured including a plurality of contact pairs and a plurality of magnets, wherein each of the plurality of contact pairs includes contacts having contact regions. The contacts are arranged allowing opening and closure with respect to each other. The plurality of contact pairs are arranged such that a plurality of magnets are aligned on one straight line, and a contact pair is located between the magnets on a line identical to the straight line. Each of the plurality of magnets is provided such that the arc generated between the contacts at the time of relay cutoff is distorted in a direction crossing the straight line. Thus, the above object of extinguishing an arc in a short time even on the occasion of backward current can be achieved.

Namely, the present invention includes a plurality of pairs of contacts, wherein the contacts in each pair open/close with respect to each other, and at least one thereof is a movable contact. The contact pairs are disposed between these magnets such that the plurality of magnets are aligned on one straight line, and the contact pairs are aligned on the same line. The magnets are arranged so that the counter magnetic pole faces correspond to different magnetic poles. By such arrangement of magnets, the arc generated between contacts on the occasion of relay cutoff can be distorted in a direction crossing the straight line.

In the direct current relay of the present invention, two or more pairs of contacts can be provided. For example, when two pairs of contacts are provided so that they can be connected in series, the contacts of the pairs at one side of the switching direction are identified as an input contact and an output contact, whereas the contact of the pairs at the other side of the switching direction is identified as a linking contact connecting the input contact and the output contact in series on the occasion of conduction.

Each of the input and output contacts has a contact region. An external terminal is connected to each of these contacts. The linking contact can be formed in the shape of a capital U, one of a pair of square brackets (a hollow rectangle with one side open), or a flat plate, for example. When the linking contact is formed in the shape of a capital U or a square bracket, the protruding sides are identified as the contact region brought into contact with the input contact or output contact. When the linking contact is formed in the shape of a flat plate, the flat face of the flat plate will be brought into contact with the input contact and the output contact.

In this case, the contact region of the input contact and one contact region of the linking contact constitute one pair of contacts, whereas the contact region of the output contact and the other contact region of the linking contact constitute the other pair of contacts.

By connecting the input contact and the output contact through the linking contact on the occasion of forming contact (conducting state), the input contact, the linking contact and the output contact will be connected in series during conduction.

At least two magnets are disposed on a line connecting the input contact and the output contact, so as to sandwich the input contact and the output contact. These magnets are arranged so that the counter magnetic pole faces correspond to different magnetic poles.

In the case where the contact pairs are disposed so that they can be connected in series, the current flowing out from the input contact is carried up to the output contact via the linking contact when respective contacts are brought into contact. When respective contacts are disconnected, all the contacts attain a non-contact state, whereby an arc will be generated between counter contacts. However, the breaking voltage is divided since respective contacts are connected in series, allowing the arc to be extinguished.

When breaking the contact in the present invention, the arc generated between contacts is blown by the magnetic field of the magnet so as to be distorted in a direction crossing the straight line. When respective contacts are arranged as shown in FIG. 1, for example, so that they can be connected in series, the current flows as indicated in FIG. 1. The line of magnetic force is generated always towards the same direction. As a result, based on Fleming's left-hand rule, the arc is distorted by the Lorentz force so as to extend in a direction orthogonal to the line connecting the contact pair and magnet, as shown in FIG. 2.

In the direct current relay of the present invention, each of the contact pairs may be configured so as to be connected in series, or in parallel.

When the contact pairs are arranged so that they can be connected in series in the present invention, the contact preferably includes an input contact, an output contact, at least one intermediate contact with two contact regions arranged between the input contact and the output contact, and a plurality of linking contacts sequentially connecting in series the input contact, the intermediate contact, and the output contact in a conducting state.

In this context, by disposing the input contact, output contact and the intermediate contact at one side of the switching direction of the contacts, and disposing the linking contact at the other side of the switching direction of the contacts, respective contacts can be connected in series through, for example, the linear opening/closing operation of the linking contacts.

The input contact, output contact and intermediate contact may be stationary contacts or movable contacts. When the input contact, output contact and intermediate contact are movable contacts, the linking contact may be a stationary contact. An external terminal is connected to each of the input contact and the output contact.

The two contact regions of the intermediate contact are brought into contact with respective different linking contacts. The intermediate contact can be formed in the shape of, for example, a capital U, a square bracket (a hollow rectangle with one side open), or a flat plate. When the linking contact is formed in the shape of a capital U or a square bracket, the ends of respective sides of the U shape or square bracket are identified as the contact regions. When the linking contact is formed in the shape of a flat plate, the side portions in the longitudinal direction of the flat plate are identified as contact regions which are brought into contact with the linking contact.

The number of linking contacts is equal to the number of intermediate contacts plus one. When contact is formed (conductive state), the input contact and one contact region of the intermediate contact are connected through one linking contact, and the output contact and the other contact region of the intermediate contact are connected through another one linking contact. When there are a plurality of intermediate contacts, two linking contacts are employed as the linking contact to connect the input contact with the intermediate contact, and a linking contact to connect the output contact with an intermediate contact. Adjacent contact regions of adjacent intermediate contacts are connected together through another linking contact. By these linking contacts, the input contact, intermediate contact, and output contact are connected in series in a conductive state.

A linking contact can be formed in the shape of, for example, a capital U, a square bracket, or a flat plate. When the linking contact is formed in the shape of a capital U or a square bracket, respective projecting sides are identified as the contact regions of a contact. When the linking contact is formed in the shape of a flat plate, two contacts of one side such as an input contact are brought into contact with the face of the flat plate.

In the case where intermediate contacts are provided in the present invention, respective contacts can be connected in series such as in the order of an input contact, a linking contact, an intermediate contact, a linking contact, and an output contact on the occasion of conduction.

The current flowing out from the input contact when respective contacts make connection passes through a linking contact, an intermediate contact, and a linking contact to arrive at the output contact. When respective contacts are disconnected, all the contacts attain a non-contact state to cause occurrence of an arc between counter contacts. However, the breaking voltage is divided since respective contacts are connected in series to allow the arc to be extinguished.

Further, it is preferable to dispose all the contacts on the same straight line also in the case where the present invention is configured employing an intermediate contact. Specifically, as shown in FIGS. 7–9, the input contact, intermediate contact, and output contact are disposed on the same straight line, and the plurality of linking contacts are disposed so as to overlap the input contact, intermediate contact, and output contact vertically on the same one line, when viewed in plane.

In the case where the input contact, output contact, and intermediate contact are disposed at one side of the switching direction of the contacts, and linking contacts are disposed at the other side of the switching direction of the contacts, the relay can be cut off by just moving forward in the switching direction at least the contacts at one side of the switching direction to achieve switching.

Among a pair of contacts that are to be opened/closed, one may be set as a movable contact and the other may be set as a stationary contact. Alternatively, both may be set as movable contacts to make/break the connection.

When all the contacts are movable contacts, all the contacts must be driven simultaneously. Specific means to establish such a timing includes, for example, those employing timer means. In other words, a drive signal to drive the movable contacts by means of a timer is output.

In the case where an intermediate contact is provided, the plurality of magnets are disposed on one straight line, and the pair of contacts is disposed between these magnets on the same line. The magnets distort the arc generated between the contacts on the occasion of the relay cutoff in a direction crossing the straight line. Although an arc will be generated between contacts at the time of cutoff, the arc can be extinguished in a short time by extending the arc outwards through the Lorentz force of the magnet.

In the present invention, the contact area of the contact region preferably takes a configuration in which the length in the direction of the straight line is shorter than the length in the direction orthogonal to the straight line.

For example, when the aforementioned two pairs of contacts are provided, the input contact and the output contact are disposed on the one same straight line, and linking contacts are disposed so as to overlap the input contact and the output contact vertically. When viewed in plane, respective contacts are set on the same one line.

In this context, a contact region is formed at each contact to be brought into contact with another contact, and the contact area of the contact region is configured such that the length in the direction of the straight line that connects respective contacts is shorter than the length in the direction orthogonal to the straight line.

A configuration of a contact area of the contact region in which the length in the direction of the straight line is shorter than the length in the direction orthogonal to the straight line includes an oblong shape such as an oval, an ellipse, a rectangle, or the like with the direction of the minor axis of the contact area corresponding to the direction of the straight line.

When the plurality of contact pairs are disposed on the same line, there is a possibility of the entire relay becoming larger in the direction of the straight line as the number of contacts increases. It is to be noted that many direct current relays employ a solenoid to drive the movable contact. Since the size of this solenoid is determined when a commercially-available product is employed, it is preferable that the contact does not protrude from the cross sectional area of the solenoid.

Various driving sources can be employed for the opening/closing operation of the contact. A motor can be employed for the driving source of the rotational system. A solenoid or cylinder can be employed for the driving source of the direct-acting system. When a rotational system driving source is employed, the contact is driven via a converting mechanism to convert a rotational motion into a reciprocating motion. When a direct-acting system driving source is employed, the contact is driven with the direct-acting system driving source linked to the contact.

In the case of a configuration in which the contacts are arranged so that they can be connected in series and an intermediate contact is provided, it is preferable to form a contact region in each contact that is to be brought into contact with another contact, and form the contact area of the contact region to have a length in the contact alignment direction shorter than the length in the direction orthogonal to the alignment direction.

The contact region of the stationary contact and movable contact is preferably formed of Ag (silver) alloy of a chemical composition including 1–9 mass % of Sn (tin) and 1–9 mass % of In (indium), and includes a first layer identified as the surface region and a second layer identified as the inner region. Preferably, the first and second layers have the micro Vickers hardness of at least 190 and not more than 130, respectively, and the thickness of the first layer is within the range of 10–360 μm.

The reason why the amount of Sn is set to 1–9 mass % is that the welding resistance of the contact will be degraded if the amount is less than 1 mass % and the temperature characteristic of the contact will be degraded if the amount exceeds 9 mass %. Preferably, the amount of Sn is 2–7 mass %.

As used herein, welding resistance refers to the low vulnerability to welding where the contact cannot be cut, particularly the state of the contact taking hold and not being able to be detached. Temperature characteristic refers to the degree of temperature increase of the contact in a conductive state. Favorable temperature characteristic implies that the temperature of the contact does not easily rise on the occasion of conduction, with less thermal effect on the cable and equipment connected to the relay.

The reason why the amount of In is set to 1–9 mass % is that the temperature characteristic of the contact is degraded when the amount is outside this range. When the amount exceeds 9 mass %, the welding resistance is degraded depending upon the amount of Sn. Preferably, the amount of In is 3–7 mass %.

The reason why the hardness of first layer (generally, 5 g weight load) is set to at least 190 in micro Vickers hardness is that the welding resistance and temperature characteristics will be degraded when the hardness is below this level. Furthermore, the reason why the hardness of the second layer is set to not more than 130 in micro Vickers hardness is that the contact will become brittle and the welding resistance is degraded if the hardness exceeds this level.

It is desirable that the first layer has a hardness of at least 240 and the second layer has a hardness of not more than 120. In the present invention, the hardness is confirmed with micro Vickers hardness at an arbitrary site in respective regions of the first layer and the second layer on a cross section perpendicular to the surface of the contact. The contact of the present invention may have a hardness distribution in each of the first and second layers.

There is a drop in hardness (at least 60 in micro Vickers hardness) at the boundary between the first layer and the second layer. This boundary includes a region (referred to as intermediate region hereinafter) having a hardness intermediate the hardness of the two layers (i.e. the hardness is within a range that is lower than the lower limit of the hardness of the first layer and that exceeds the upper limit of the hardness of the second layer).

The first layer has a thickness of 10–360 μm. If the thickness is less than the lower limit, the welding resistance and temperature characteristic will be degraded. If the thickness exceeds the upper limit, the temperature characteristic of the contact is degraded. Preferably, the thickness is 30–120 μm. The contact having a first layer and second layer may include those with an intermediate region. It is desirable that the thickness of the intermediate region is not more than 200 μm. If the thickness thereof exceeds 200 μm, the temperature characteristic of the contact is easily degraded. Preferably, the thickness is equal to or less than 100 μm.

In addition to the above-described basic component, the contact may include, as a subcomponent, at least one element selected from the group consisting of Sb (antimony), Ca (calcium), Bi (bismuth), Ni (nickel), Co (cobalt), Zn (zinc) and Pb (lead). Generally, most of these components are dispersed in the form of a compound, particularly an oxide, in the Ag matrix.

It is to be noted that the desirable dispersion range differs depending upon each component. For example, the ranges are 0.05–2 (Sb), 0.03–0.3 (Ca), 0.01–1 (Bi), 0.02–1.5 (Ni), 0.02–0.5 (Co), 0.02–8.5 (Zn), and 0.05–5 (Pb) in element-converted mass % unit. The element in the parenthesis refers to the subject element. If the amount falls outside the range set forth above for each of the foregoing components, the temperature characteristic may be degraded depending upon the type of the direct current relay. Particularly, excess of the upper limit may also cause degradation in the welding resistance, depending upon the type of the relay.

In general, the subcomponents set forth above affect somewhat of the contact performance. Other components thereof are cited in the following. A slight amount of any thereof may be included within the range according to the object of the present invention. The desirable containing amount differs depending upon the component. The values in the parenthesis corresponding to a symbol of element is represented in element-converted mass % unit whereas those corresponding to a molecular formula is the tolerable upper limit represented in the relevant molecule-converted mass % unit. Ce (5), Li (5), Cr (5), Sr (5), Ti (5), Te (5), Mn (5), $AlF_3$ (5), $CrF_3$ (5) and $CaF_2$ (5), Ge (3) and Ga (3), Si (0.5), Fe (0.1) and Mg (0.1).

As the method to form a contact having a first layer and a second layer, the molten casting method, powder metallurgy, and the like can be cited.

For example, the molten casting method includes the procedures set forth below. First, ingots subjected to molten casting so as to correspond to respective chemical compositions for the first and second layers are prepared. These ingots are rolled roughly, and the two rolling members are hot-pressed. At that stage, or a later stage, a thin connection layer such as of pure Ag set forth above, if necessary, is attached by compression.

Further rolling is applied to form a sheet of a predetermined thickness. Punching, or further forming is applied to achieve a Ag alloy material of a size approximating the final configuration. Then, the material is subjected to internal oxidation (post-oxidation) such that the metal components of Sn, In and the like are converted into oxides.

Prior to the molten casting method, a compound other than the oxides of the constituent elements can be included. Additionally, a thermal treatment or a step of adjusting the configuration, and the like can be applied appropriately, subsequent to the rolling step, as necessary. In this case, the fine structure of each layer can be controlled intentionally to alter the material property, the level thereof, and the like by devising the thermal treatment condition.

When the contact region is to be produced by powder metallurgy, two predetermined compositions of powder such as Sn and In, and powder of Ag, for example, are blended and mixed, followed by thermal treatment for internal oxidation (pre-oxidation). The obtained two types of powder are layered and filled in a mold to be subjected to compression molding, resulting in a preform. The powder of Sn, In and the like and the powder of Ag may be mixed together with another compound.

Various types of deformation processes such as hot extrusion, hot/cold rolling, hot forging and the like can be applied to the preform. A thermal treatment and/or a step to adjust the configuration are added, as necessary, subsequent to the rolling step, likewise the casting method set forth above. Each layer can have its property controlled to a desired level by devising the thermal treatment condition.

After the material of the second layer alone is prepared by the procedure conforming to the aforementioned molten casting method or powder metallurgy, the first layer can be formed by various means such as thick film formation through thermal spraying, CVD (Chemical Vapor Deposition) and the like, thick film printing through screen printing and the like, coating followed by baking, and the like. Bonding of the alloy sheet constituting the first layer and the alloy sheet constituting the second layer can be effected by various means such as diffusion joining through hot isostatic pressing, hot extrusion and the like. Furthermore, by applying thermal treatment, the fine structure of each layer can be controlled intentionally to achieve a desired property.

In the relay of the present invention, the Ag alloy material forming the contact is within the range of the conditions set forth above, and include those having the same chemical composition for the first layer and the second layer. When the first and second layers have the same chemical composition, the hardness of respective layers are set different by means set forth afterwards.

For example, the first layer alone is rapidly heated and rapidly cooled so that the residual stress of the first layer is greater than that of the second layer. Alternatively, the method including the step of applying shot blasting to the first layer at the surface for hardening can be employed.

There is also the method of applying hot rolling or cold rolling and then a thermal treatment to the Ag alloy sheet, i.e. applying the so-called thermo mechanical processing (heat process), followed by internal oxidation to precipitate needle-like oxide particles smaller than those of the second layer at the first layer to increase the hardness at the surface. There is also the method of altering the forging ratio between the first and second layers when the Ag alloy sheets of the first and second layers are subjected to rolling and hot pressing.

Further, the material of the contact region is within the range of the conditions set forth above, and also includes those whose amount of Sn in the first layer is equal to or greater than that in the second layer. This ensures that the hardness of the first layer is higher than that of the second layer.

In the formation step of the contact region by molten casting, powder metallurgy and the like, the first and second layers are preferably subjected to internal oxidation. The internal oxidation includes post-oxidation and pre-oxidation.

Post-oxidation is known as the method of conducting internal oxidation after finishing or nearly finishing in the final contact configuration in the alloy form.

Pre-oxidation is known as the method of subjecting the powder or particles of the alloy to internal oxidation, followed by molding, compression and sintering the same.

Since the arc generated between contacts of a contact pair on the occasion of cut off is distorted in a direction crossing a straight line along which magnets and contact pairs are aligned, the relay can be cut off in a short time by the voltage cutoff of multi-contacts through the plurality of contact pairs and blow out of an arc by the magnet.

In accordance with the present invention, by dividing the breaking voltage and blowing away the arc through the magnet, the arc voltage is raised in a short time to allow the relay to be cut off in a short time.

Since the arc energy is consumed with the extension of arc through the magnet while cutting off the voltage by the multi-contact, it is no longer necessary to ensure a predetermined amount of arc extension required for voltage cutoff as in the conventional case. Furthermore, the magnetic force of the magnet to be used can be lowered as compared to the conventional case, allowing down-sizing of the magnet.

Since the arc extension direction corresponds to a direction crossing the straight line that connects the contact pairs (the direction crossing the straight line corresponding to the contact aligned direction), arcs will not be linked with each other even if a backward current such as regenerative energy is generated. A backward current can be accommodated sufficiently.

Since a pair of contact is provided between a plurality of magnets, it is no longer necessary to provide a pair of magnets for each contact pair. The number of magnets used can be reduced as compared to those of a conventional relay (Japanese Patent No. 3321963). Therefore, the cost can be reduced.

Furthermore, in the case where the contact area of the contact region is formed such that the length in the contact aligning direction (the straight line direction) is shorter than the length in the direction orthogonal to the straight line direction, increase of the length in said direction of the straight line, i.e. the contact aligning direction of the relay, can be suppressed to the minimum level while ensuring sufficient contact area of the contact. Therefore, the relay can be reduced in size.

When a solenoid is to be employed with the plurality of contact pairs aligned in one row, effective space is achieved in the area of the cross section of the solenoid in the direction orthogonal to the straight line direction. By extending the contact area towards the effective space and reducing the length in the aligning direction, the volume of the entire relay can be reduced.

Further, in the case where a solenoid, for example, is employed in the relay, effective space as set forth above is achieved in the direction orthogonal to the straight line direction. Since this effective space can be employed as the space for extending the arc, it is no longer necessary to provide extra space for the arc.

In the case where a configuration is employed in which respective contacts are arranged so that they can be connected in series, and an intermediate contact and a plurality of linking contacts are provided, increase of the length in the contact aligning direction can be suppressed to the minimum while ensuring sufficient contact area of the contact even if the number of contact pairs increases by disposing all the contacts on the same one line and forming the contact area of the contact region in the shape as set forth before.

In the case where contact pairs are arranged so that they can be connected in series in a conducting state, division of the voltage between the contacts on a cutoff occasion allows the voltage to be cut off in a shorter time. As a result, damage of the contact through the arc current can be suppressed by reducing the voltage across the contacts.

By increasing the number of contacts and connecting these contacts in series, a hermetic structure of sealing the extinction gas is no longer required. Therefore, a direct current relay can be fabricated economically.

In the case where the contact pairs are arranged so that they can be connected in in parallel in a conducting state, the current can be divided. By reducing the current flowing across one contact, damage of the contact caused by arc current can be suppressed.

Furthermore, by forming the contact region of the contact with a material superior in welding resistance, the contact will not be welded even if a large current flows during short-circuiting of the relay. Thus, cutoff can be achieved reliably.

BEST MODE FOR CARRYING OUT THE INVENTION

Embodiments of the present invention will be described hereinafter.

FIRST EMBODIMENT

Figure 3:
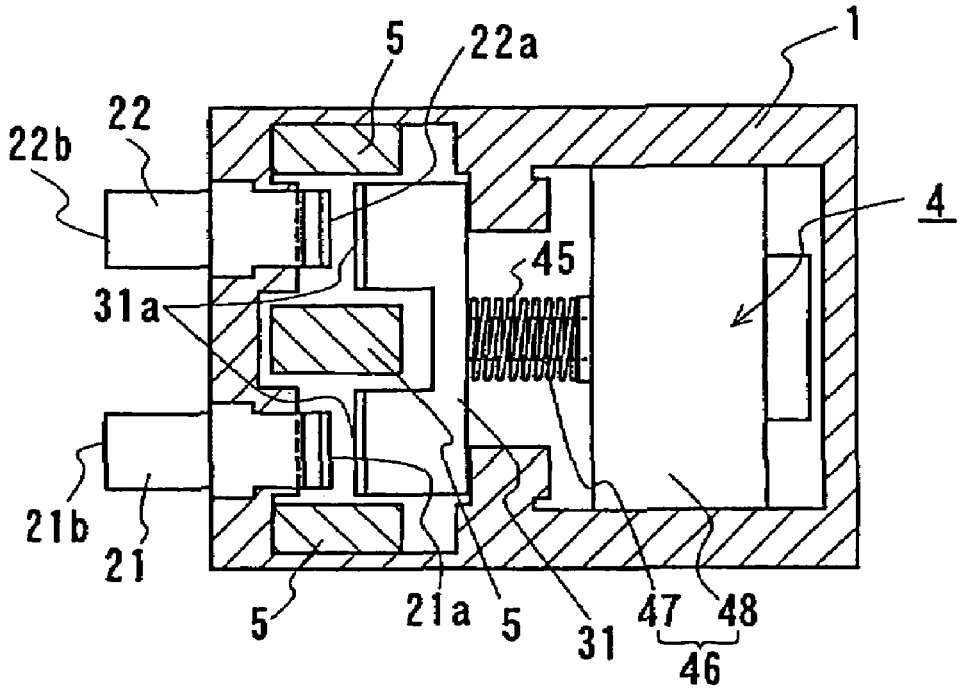
FIG. 3 is a longitudinal sectional view showing a schematic structure of the direct current relay of the present invention in accordance with the first embodiment.
Figure 4:
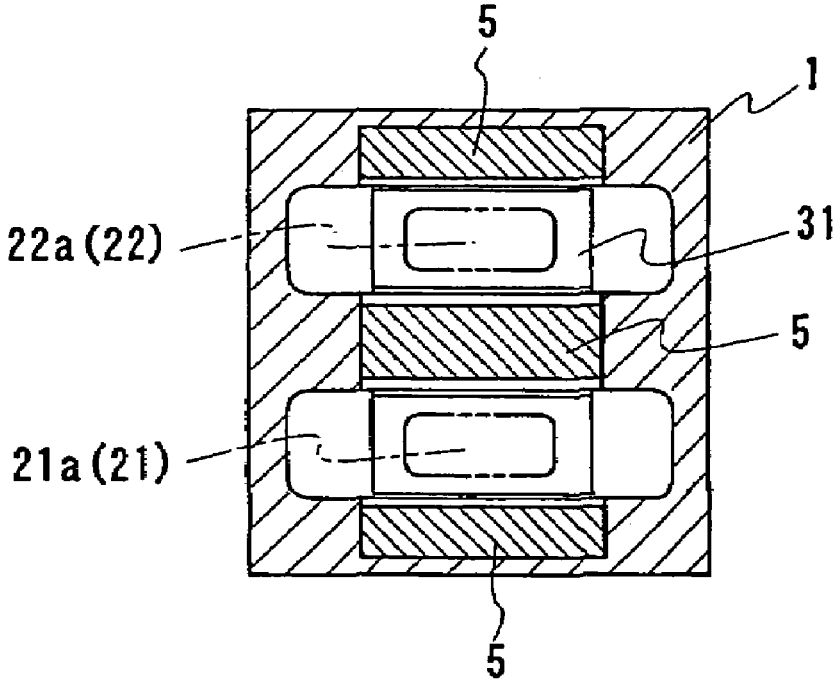
FIG. 4 is a transverse sectional view showing a schematic structure of the direct current relay of the present invention in accordance with the first embodiment.

A direct current relay according to a first embodiment includes in a casing 1, as shown in FIG. 3, an input contact 21 and an output contact 22 that are stationary contacts, a linking contact 31 that is a movable contact, and a contact driving mechanism 4.

Input and output contacts 21 and 22 include contact regions 21*a* and 22*a* to be brought into contact with linking contact 31, and terminal connections 21*b* and 22*b*, respectively. An external terminal is connected to each of terminal connections 21*b* and 22*b*.

Linking contact 31 is U-shaped in cross section. The flat face at both sides of this U shape is identified as a contact region 31*a*. Contact region 31*a* of linking contact 31 is brought into contact with contact region 21*a* of input contact 21 and contact region 22*a* of output contact 22.

In the present embodiment, contact region 21*a* of input contact 21 and one contact region 31*a* of linking contact 31 constitute one contact pair, whereas contact region 22*a* of output contact 22 and the other contact region 31*a* of linking contact 31 constitute another contact pair.

Each contact region of input contact 21, linking contact 31 and output contact 22 is formed of Ag alloy of a chemical composition including 1–9 mass % of Sn and 1–9 mass % of In. The contact region includes a first layer corresponding to the surface region and a second layer corresponding to the inner region. The first layer and the second layer have a micro Vickers hardness of at least 190 and not more than 130, respectively. The thickness of the first layer is within the range of 10–360 μm. Each contact region is subjected to internal oxidation by post-oxidation in the form of a chip.

The internal oxidation is effected by maintaining the chip for 170 hours at 750° C. in an oxygen ambient of 4 atmospheres (405.3 kPa).

Input contact 21, linking contact 31 and output contact 22 are disposed so as to be located on one same straight line. Specifically, arrangement is established such that, when one contact region 31*a* of linking contact 31 is brought into contact with contact region 21*a* of input contact 21 and the other contact region 31*a* of linking contact 31 is brought into contact with contact region 22*a* of output contact 22, the contact pairs of such connecting state are aligned on the same straight line.

By disposing respective contacts as set forth above and bringing the contact region of each contact into contact, respective contacts are connected in series from input contact 21 to output contact 22 via linking contact 31.

Contact region 21*a* of input contact 21 and contact region 22*a* of output contact 22 have an oblong face at the area that is to form contact with the contact region of linking contact 31. Each of contact regions 21*a* and 22*a* is provided such that the minor axis direction of the oblong face of the contact area corresponds to the aligning direction of respective contacts (said straight line direction). A metal cylindrical block having an oblong contact area for contact regions 21*a* and 22*a* is employed as input contact 21 and output contact 22.

As shown in FIG. 3, linking contact 31 achieves a reciprocating motion in the contact switching direction by contact driving mechanism 4. By switching the contact through contact driving mechanism 4, linking contact 31 attains a contacting or non-contacting state with respect to input contact 21 and output contact 22.

Contact driving mechanism 4 will be described specifically hereinafter. Contact driving mechanism 4 includes a spring 45, and a solenoid 46. Spring 45 is arranged between linking contact 31 and a shaft activate unit 48 of solenoid 46. A driving shaft 47 of solenoid 46 is passed through spring 45. Spring 45 urges linking contact 31 in a direction away from input contact 21 and output contact 22, i.e. in the contact opening direction.

Solenoid 46 serves to cause linking contact 31 to reciprocate in the contact switching direction, and includes a driving shaft 47 having one end fixed to linking contact 31, and a shaft activate unit 48 to cause driving shaft 47 to reciprocate in the contact switching direction. Driving shaft 47 has one end side fixed at an intermediate site of linking contact 31, and the other end side inserted in a hole (not shown) formed in shaft activate unit 48.

When in an ON state where current flows, where shaft activate unit 48 moves driving shaft 47 in a direction exiting from the hole (contact opening direction). Specifically, when shaft active state 48 is ON, driving shaft 47 is moved against the spring force of spring 45 in a direction causing linking contact 31 to form contact with input contact 21 and output contact 22 (contact closing direction).

When shaft activate unit 48 is OFF, the extended spring 45 is restored to its original status, and driving shaft 47 moves through the spring force of spring 45 in a direction away from input contact 21 and output contact 22 (contact opening direction).

Linking contact 31 reciprocates in accordance with the movement of driving shaft 47 of solenoid 46. When linking contact 31 moves in a contact closing direction, contact regions 31*a* of linking contact 31 are brought into contact with contact regions 21*a* and 22*a* of input contact 21 and output contact 22, simultaneously.

When linking contact 31 moves in the contact opening direction, contact regions 31*a* of linking contact 31 are drawn away from contact regions 21*a* and 22*a* of input contact 21 and output contact 22, simultaneously. As such, linking contact 31 is driven to open/close with respect to input contact 21 and output contact 22 through contact driving mechanism 4.

A direct current power supply is connected to terminal connection 21*b* of input contact 21 via a terminal (not shown), whereby conduction/cutoff is effected by establishing connection or disconnection of respective contacts.

In the present embodiment, the direct current relay includes three sheet-like permanent magnets 5 in casing 1. Permanent magnets 5 are located between input contact 21 and output contact 22, and at respective outer sides of input contact 21 and output contact 22.

Figure 1:
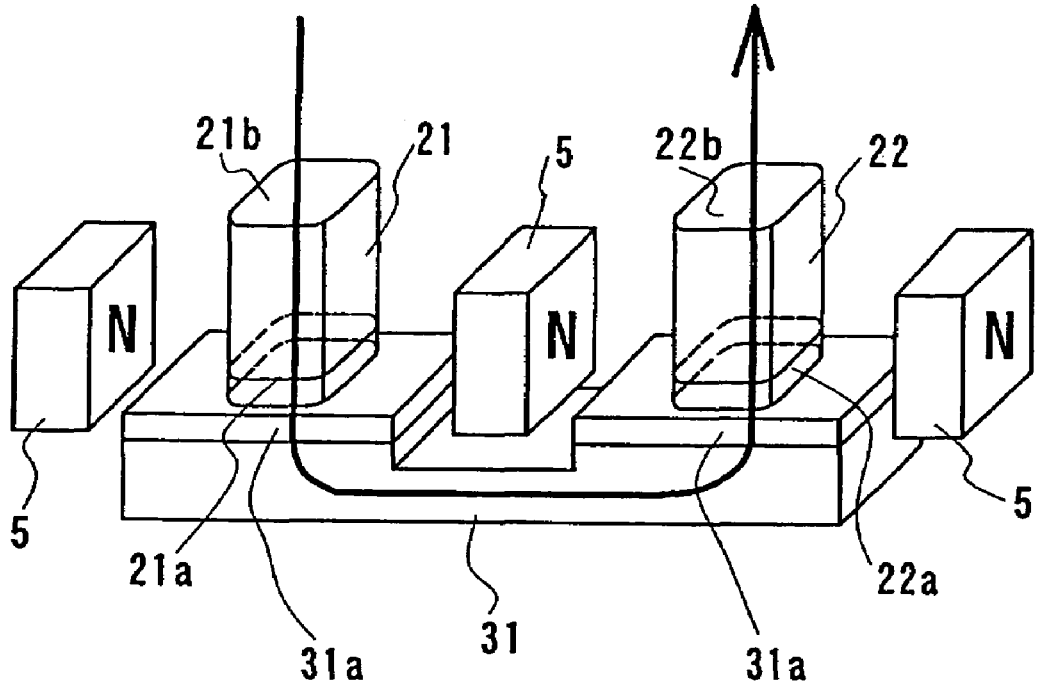
FIG. 1 is a schematic view of a direct current relay with contacts that can be connected in series according to a first embodiment of the present invention, corresponding to a conductive state where contact is established.
Figure 2:
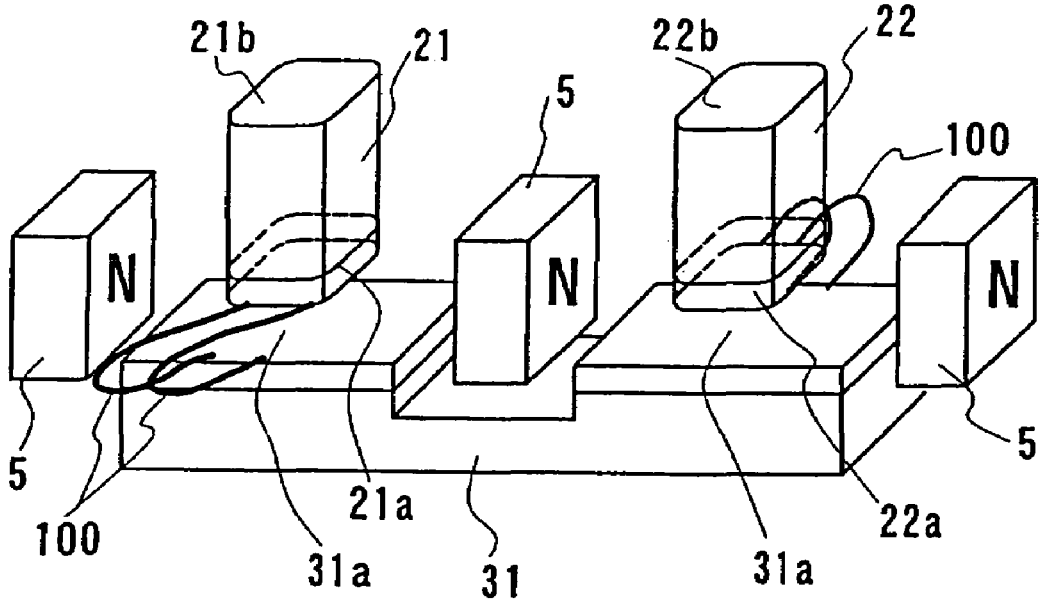
FIG. 2 is a schematic view of a direct current relay with contacts that can be connected in series according to the first embodiment of the present invention, corresponding to a cutoff state where contact is not established.

Further, permanent magnets 5 are aligned on one straight line identical to the line where contact pairs are aligned, as shown in FIGS. 1 and 2, such that one pole (for example, N pole) is located at the same side. By these permanent magnets 5, a magnetic field is to be applied between contact region 21*a* of input contact 21 and one contact region 31*a* of linking contact 31, and between contact region 22*a* of output contact 22 and the other contact region 31*a* of linking contact 31. The magnetic field of permanent magnet 5 causes an arc 100 that is generated between respective contacts on the occasion of contact cutoff to be extended and distorted by the Lorentz force.

In a contact conducting mode of the present invention, current flows from input contact 21 to flow in series to output contact 22 via linking contact 31. In the state shown in FIG. 2, permanent magnets 5 are disposed such that the line of magnetic force flows from left to right. Therefore, based on Fleming's left hand rule, the Lorentz force induces alternately a frontward force and a backward force in FIG. 2, whereby arc 100 generated at the time of contact cutoff is distorted frontwards and backwards alternately.

Contact conduction and cut off will be described here. When conduction is to be established by closing the contacts, respective contacts attain the conducting state by closing linking contact 31 to bring linking contact 31 into contact with input contact 21 and output contact 22 (state of FIG. 1).

When connection is to be opened across the contacts to achieve cutoff, the opening operation of linking contact 31 causes disconnection of linking contact 31 from input contact 21 and output contact 22 to achieve cutoff (state of FIG. 2).

On the occasion of cutoff, arc 100 generated between respective contacts is distorted in the direction set forth above by the magnetic field of permanent magnets 5.

The connection of two pairs of contacts in series in the present embodiment is advantageous in that an arc 100 can be extinguished with the breaking voltage being divided and with arc 100 extended by the magnetic field. Therefore, the voltage can be cut off in a short time. Furthermore, an extremely compact direct current relay can be realized. Since respective contacts are arranged in series for division of the breaking voltage, the durability of the contacts can be improved.

The extending direction of the arc differs alternately along the aligned direction of contacts and magnets. Therefore, arcs will no longer be linked together even if a backward current such as of regenerative energy is generated. Backward current can be accommodated sufficiently.

In the direct current relay of the first embodiment, the contact region of each contact is formed of a material superior in welding resistance. Therefore, the contact will not be welded and can be disconnected even if a large current flows during short-circulting.

SECOND EMBODIMENT

In the first embodiment, a direct current relay that can have contact pairs connected in series in a conducting state was described. The second embodiment is directed to allowing contact pairs to be connected in parallel in a conducting state.

Figure 5:
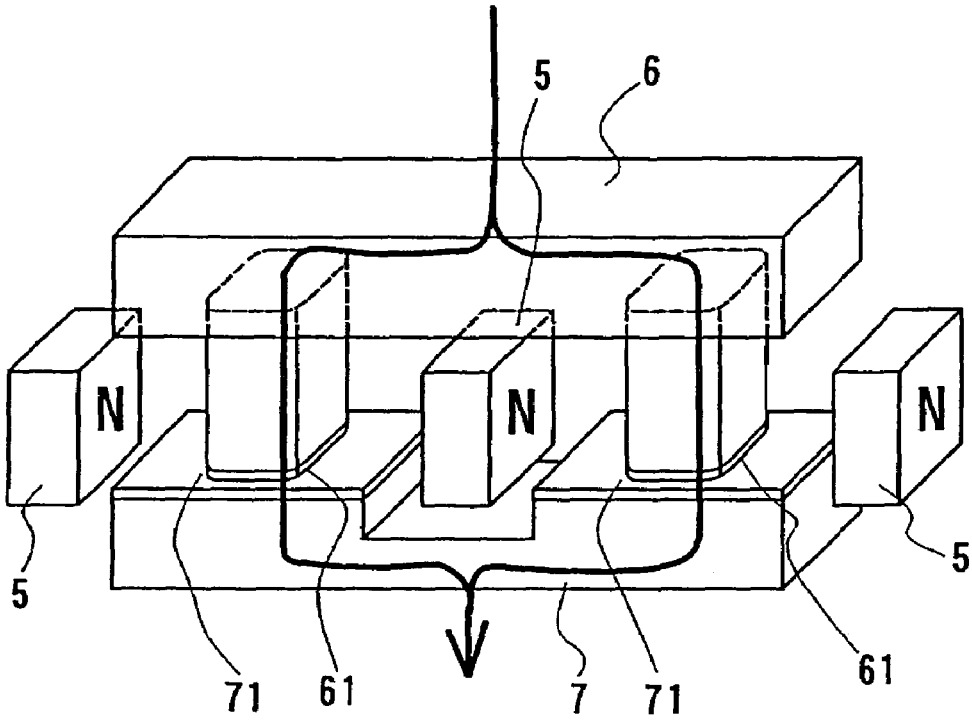
FIG. 5 is a schematic view of a direct current relay with contacts that can be connected in parallel according to a second embodiment of the present invention, corresponding to a conductive state where contact is established.
Figure 6:
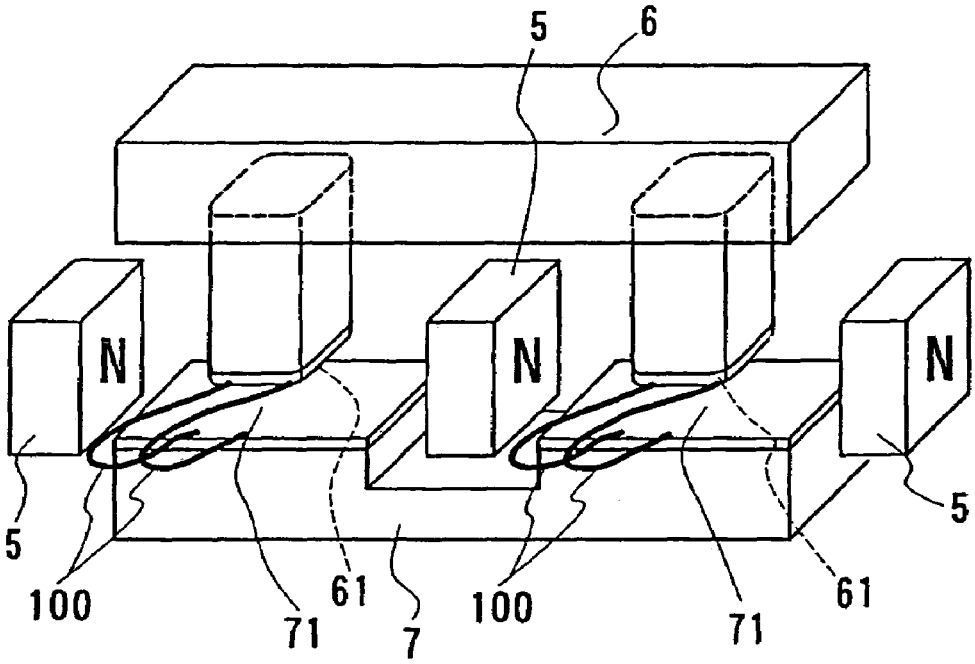
FIG. 6 is a schematic view of the direct current relay with contacts that can be connected in parallel according to the second embodiment of the present invention, corresponding to a cutoff state where contact is not established.

As shown in FIGS. 5 and 6, the direct current relay according to the second embodiment includes an input contact 6 identified as a fixed contact, and an output contact 7 identified as a movable contact. Both input contact 6 and output contact 7 have an approximately U shape in cross section. The flat face at both sides of this U shape are identified as contact regions 61 and 71. Each of these contacts includes two contact regions 61 and 71. The two contact regions 61 of input contact 6 are brought into contact with two contact regions 71, respectively, of counter output contact 7.

In the present embodiment, one contact region 61 of input contact 6 and one contact region 71 of output contact 7 constitute one contact pair. The other contact region 61 of input contact 6 and the other contact region 71 of output contact 7 constitute another contact pair.

Input contact 6 and output contact 7 are disposed so that respective contact regions 61 and 71 are located on one same straight line in a connecting state. By such arrangement of respective contacts and establishing contact of respective contact regions of each contact, as shown in FIG. 5, respective contact pairs are connected in parallel from input contact 6 to output contact 7.

In the present embodiment, respective contact regions 61 and 71 of input contact 6 and output contact 7 are formed of Ag alloy of the chemical composition including 1–9 mass % of Sn and 1–9 mass % of In. The contact region includes a first layer corresponding to the surface region and a second layer corresponding to the inner region. The first layer and the second layer have a micro Vickers hardness of at least 190 and not more than 130, respectively. The thickness of the first layer is within the range of 10–360 μm. Each contact region is subjected to internal oxidation by post-oxidation in the form of a chip. The internal oxidation is effected, for example, by maintaining the chip for 170 hours at 750° C. in an oxygen ambient of 4 atmospheres (405.3 kPa).

The contact area of each contact region 61 of input contact 6 has an oblong face in the second embodiment. Each of contact regions 61 is provided such that the minor axis direction of the oblong face of the contact area corresponds to the aligning direction of respective contacts (said straight line direction).

Likewise in the present embodiment, three permanent magnets 5 are provided between contact regions 61 of input contact 6, and at respective outer sides of two contact regions 61. Permanent magnets 5 are aligned on one straight line, as shown in FIGS. 5 and 6, such that one pole (for example, N pole) is located at the same side. By these permanent magnets 5, a magnetic field is to be applied between contact region 61 of input contact 6 and contact region 71 of output contact 7. The magnetic field of permanent magnet 5 causes an arc 100 that is generated between respective contacts on the occasion of contact cutoff to be extended and distorted by the Lorentz force.

In a contact conducting mode of the present embodiment, current flows from input contact 6 to flow in parallel to output contact 7 via the two contact regions. In the state shown in FIG. 6, permanent magnets 5 are disposed such that the line of magnetic force flows from left to right. Therefore, based on Fleming's left hand rule, the Lorentz force induces a frontward force in FIG. 6, whereby arc 100 generated at the time of contact cutoff is entirely distorted frontwards.

Even in the case where respective contact pairs are disposed to allow connection in parallel, arcs will not interfere with each other during conduction, and arc interference is suppressed even when a backward current flows.

The direct current relay of the second embodiment has the contact region of each contact formed of a material superior in welding resistance. Therefore, the contact can be disconnected without the contacts being welded even if a large current flows during short-circuiting.

THIRD EMBODIMENT

Figure 9:
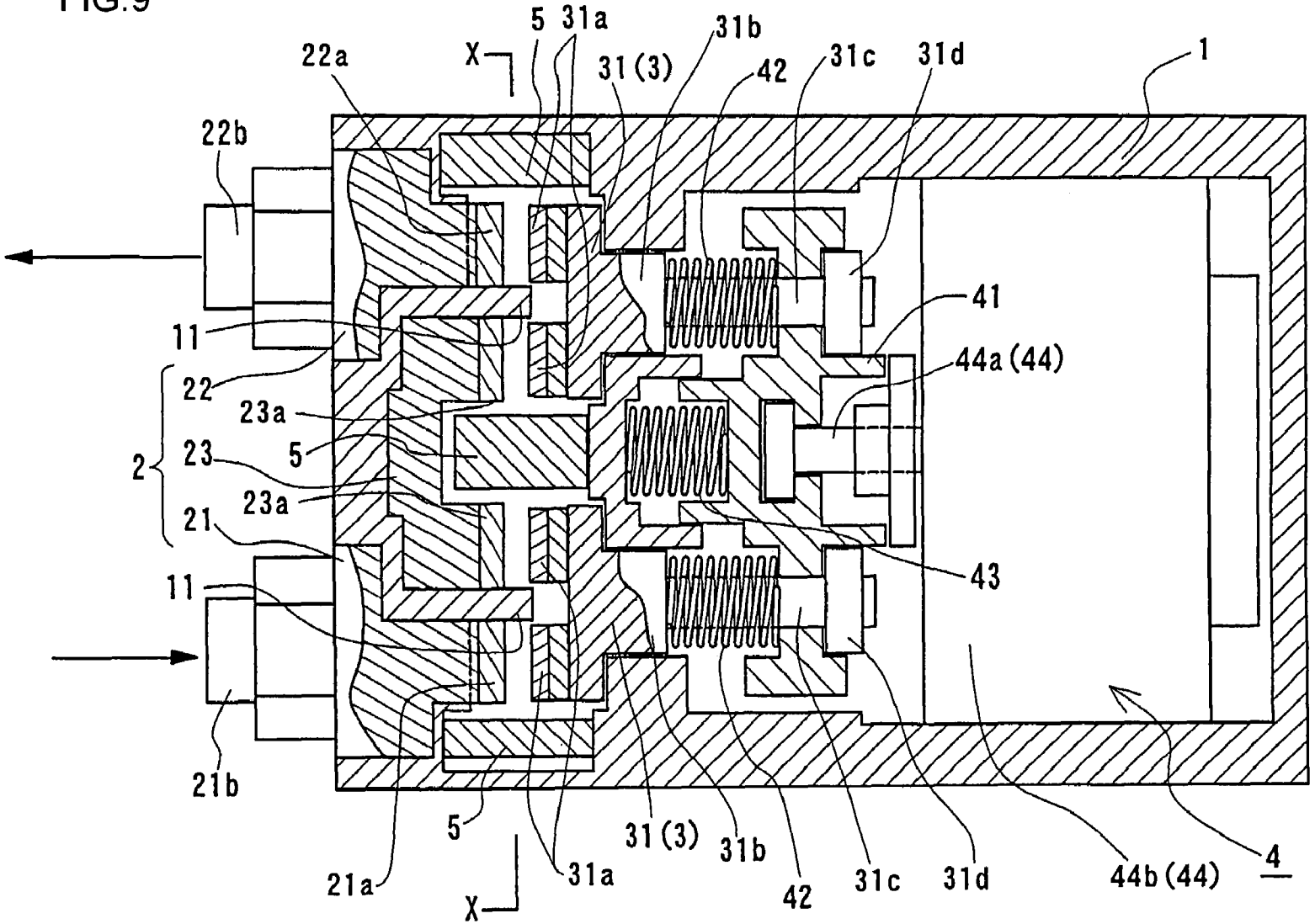
FIG. 9 a longitudinal sectional view showing a specific structure of the direct current relay of the present invention in accordance with the third embodiment.

As shown in FIG. 9, a direct current relay according to a third embodiment includes, in casing 1, a plurality of stationary contacts 2, a plurality of movable contacts 3, and a contact driving mechanism 4.

Stationary contact 2 includes, as shown in FIG. 9, an input contact 21 to which an external terminal is connected, an output contact 22, and one intermediate contact 23 disposed between contacts 21 and 22.

Input contact 21 and output contact 22 include respective one of contact regions 21*a* and 22*a* to be brought into contact with movable contact 3, and terminal connections 21*b* and 22*b*, respectively. Terminal connections 21*b* and 22*b* protrude from casing 1.

Intermediate contact 23 has a U shape or a square bracket shape in cross section. A contact region 23*a* to be brought into contact with movable contact 3 is formed at each end side of the U shape. Although not shown, input contact 21, output contact 22 and intermediate contact 23 are secured in casing 1 by a screw and the like, Movable contact 3 includes two linking contacts 31 that is brought into contact with contact region 21*a* of input contact 21 of stationary contact 2 and one contact region 23*a* of intermediate contact 23, and with contact region 22*a* of output contact 22 and one contact region 23*a* of intermediate contact 23.

Linking contact 31 includes a support unit 31*b* with a flat region, and two contact regions 31*a*. Contact region 31*a* is fixed to the flat region of support unit 31*b* to establish contact with any of contact region 21*a* of input contact 21, contact region 22*a* of output contact 22, and contact region 23*a* of intermediate contact 23.

Arrangement is established in casing 1 such that input contact 21, intermediate contact 23, output contact 22, and linking contact 31 are located on one same straight line. Specifically, in a state where stationary contact 2 and movable contact 3 overlap, respective contacts are disposed so as to be located on one same line when viewed from the non-contacting face of one contact.

By such arrangement of contacts, establishing connection of the contact region of respective contacts leads to the connection of respective contacts in series, from input contact 21 to output contact 22 via one linking contact 31, intermediate contact 23, and the other linking contact 31.

Contact region 21*a* of input contact 21, contact region 22*a* of output contact 22, contact region 23*a* of intermediate contact 23, and contact region 31*a* of linking contact 31 are formed of Ag alloy of the chemical composition including 1–9 mass % of Sn and 1–9 mass % of In. The contact region includes a first layer identified as the surface region and the second layer identified as the inner region. The contact region is formed of a material wherein the first and second layers have a micro Vickers hardness of at least 190 and not more than 130, respectively, and the thickness of the first layer is within the range of 10–360 μm. Each contact region is subjected to internal oxidation by post-oxidation in the form of a chip. The internal oxidation is effected by maintaining the chip for 170 hours at 750° C. in an oxygen ambient of 4 atmospheres (405.3 kPa).

Figure 10:
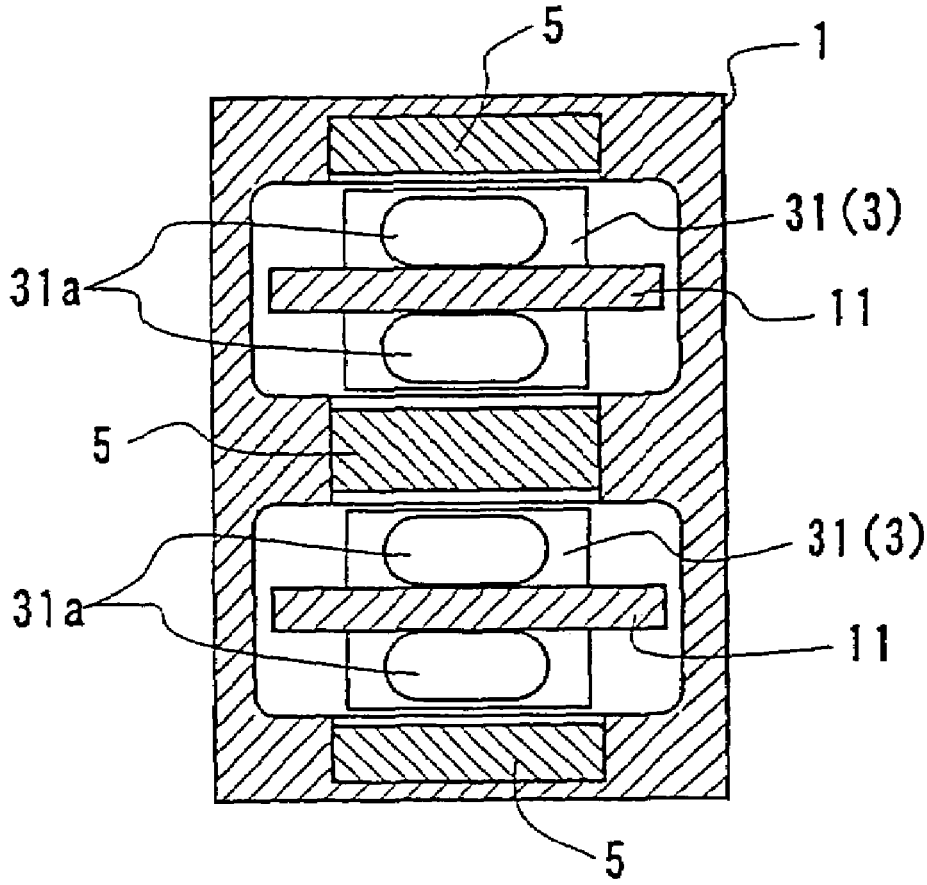
FIG. 10 is a sectional view of the direct current relay of the present invention in accordance with the third embodiment taken along line X—X of FIG. 9.

Contact region 21*a* of input unit 21, contact region 22*a* of output contact 22, contact region 23*a* of intermediate contact 23 and contact region 31*a* of linking contact 31 are formed so that the contacting area that is to be brought into contact with the other contact region has an oblong face (for example, refer to FIG. 10 for contact region 31*a* of linking contact 31). Each contact region is disposed so that the direction of the minor axis of the oblong contact area corresponds to the aligning direction of respective contacts. A cylindrical metal block having an oblong contact area is employed for each contact region.

Linking contact 31 is set to reciprocate in the contact switching direction by contact driving mechanism 4. The contacts are opened/closed by contact driving mechanism 4, and linking contact 31 attains a contacting or non-contacting state with respect to input contact 21, output contact 22 and intermediate contact 23.

Contact driving mechanism 4 will be described specifically hereinafter. Contact driving mechanism 4 includes a contact member 41, two first springs 42, one second spring 43, and a solenoid 44.

Support member 41 supports in an insertable manner a support shaft 31*c* having one side end fixed to a support region 31*b* of linking contact 31. A flange 31*d* is provided at the other end side of support shaft 31*c*.

First spring 42 is disposed between support member 41 and support region 31*b*. Support shaft 31*c* passes through first spring 42. Second spring 43 is disposed between support member 41 and casing 1 to bias support member 41 in a contact opening direction.

Solenoid 44 serves to cause support member 41 to reciprocate in the contact switching direction, and includes a driving shaft 44*a* having one end fixed to support member 41, and a shaft activate unit 44*b* to cause driving shaft 44*a* to reciprocate in the contact switching direction. Driving shaft 44*a* has one end side fixed at an intermediate site of support member 41, and the other end side inserted in a hole (not shown) formed in shaft activate unit 44*b*.

When in an ON state where current flows, shaft activate unit 44*b* moves driving shaft 44*a* in a direction exiting from the hole (contact closing direction). Specifically, when shaft active state 44*b* is ON, driving shaft 44*a* is moved against the spring force of second spring 43 in a direction towards stationary contact 2 (contact closing direction), causing movable contact 3 to form contact with stationary contact 2. When shaft active state 44*b* is OFF, driving shaft 44*a* is moved away from stationary contact 2 by the spring force of second spring 43 (contact opening direction).

Support member 41 reciprocates in accordance with the movement of driving shaft 44*a* of solenoid 44. When support member 41 moves in the contact closing direction, support region 31*b* of linking contact 31 is urged towards stationary contact 2 via first spring 42 by support member 41, whereby contact regions 31*a* of two linking contacts 31 are brought into contact with contact regions 21*a*, 22*a* and 23*a* of stationary contact 2 at the same time.

When support member 41 moves in the contact opening direction, support region 31*b* of linking contact 31 is pulled back by support member 41 via flange 31*d* of support shaft 31. Contact regions 31*a* of the two linking contacts 31 are drawn away simultaneously from contact regions 21*a*, 22*a* and 23*a* of stationary contact 2. By contact driving mechanism 4, movable contact 3 opens/closes with respect to stationary contact 2.

A direct current power supply is connected to terminal connection 21*b* of input contact 21 via a terminal (not shown). Conducting/cut off is effected by establishing connection/disconnection of respective contacts.

In the present embodiment, the direct current relay includes three sheet-like permanent magnets 5 in casing 1. Permanent magnets 5 are disposed at two sites of the non intermediate contact side of input contact 21 and output contact 22, and at one site between linking contacts 31 between two contact regions 23*a* of intermediate contact 23.

Figure 8:
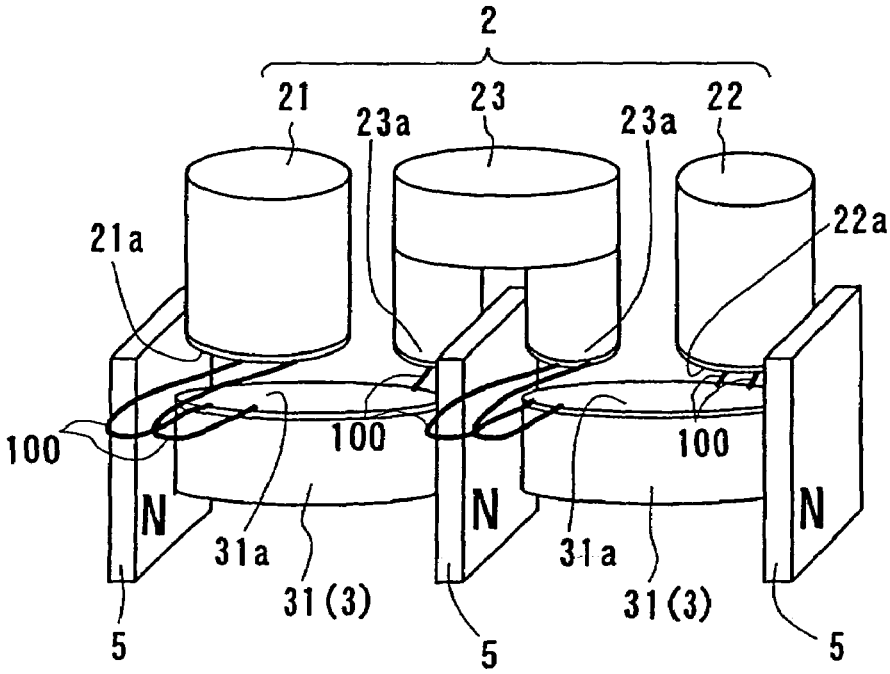
FIG. 8 is a schematic view of the direct current relay with many contacts that can be connected in series according to the third embodiment of the present invention, corresponding to a cutoff state where contact is not established.

As shown in FIG. 8, permanent magnets 5 are disposed on one straight line so that one pole (for example, N pole) is always located at the same side. A magnetic field is applied between stationary contacts 2 and movable contact 3 by these permanent magnets 5. The magnetic field of permanent magnets 5 causes arc 100 that is generated between respective contacts during contact cutoff to be extended and distorted by the Lorentz force.

In the present embodiment, current flows from input contact 21 in a contact conducting state, whereby current flows in series to output contact 22 via linking contact 31, intermediate contact 23, and linking contact 31. In the state shown in FIG. 8, permanent magnets 5 are disposed so that the line of magnetic force flows from left to right. By Fleming's left hand rule, the Lorentz force induces a frontward force and backward force alternately in FIG. 8, whereby arc 100 generated at the time of contact cutoff is distorted frontwards and backwards alternately.

Figure 7:
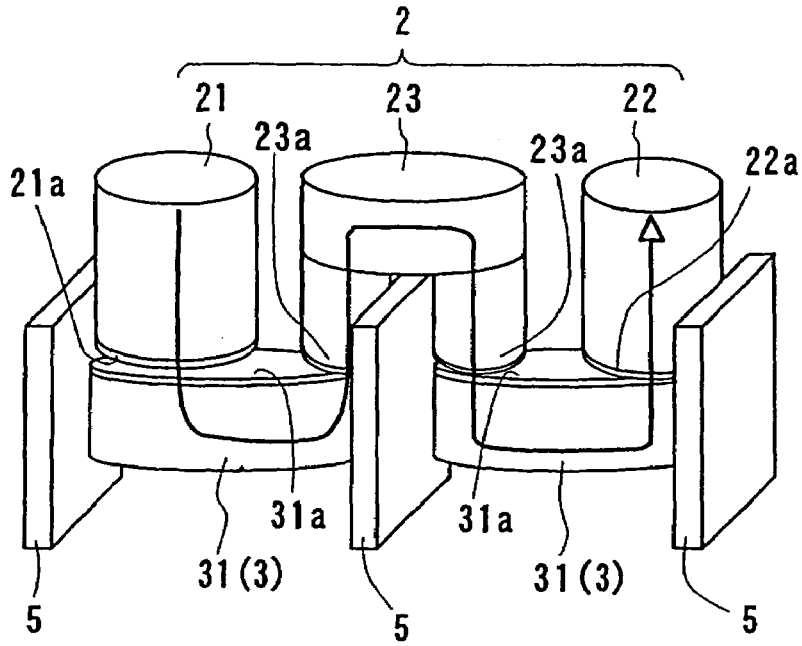
FIG. 7 is a schematic view of a direct current relay with many contacts that can be connected in series according to a third embodiment of the present invention, corresponding to a conductive state where contact is established.

Contact conduction and cutoff will be described here. When a conducting state is to be achieved by closing the contacts, movable contact 3 is closed to form contact between movable contact 3 and stationary contact 2. Thus, a conducting state is achieved (the state in FIG. 7).

When contacts are to be opened for cutoff, the opening operation of movable contact 3 causes detachment between movable contact 3 and stationary contact 2 for cutoff (the state in FIG. 8). Although arc 100 is generated between stationary contact 2 and movable contact 3 at the time of this cutoff, arc 100 is distorted in the direction set forth above by the magnetic field of permanent magnets 5.

Since a plurality of contacts are connected in series in the present embodiment, the breaking voltage can be divided to effect arc extinguishing. Therefore, the voltage can be cut off in a short time. As a result, a hermetic structure around the contact is not required. Since arc 100 can be extinguished indispensible of great extension, an extremely compact direct current relay can be realized. Furthermore, since respective contacts are disposed in series to divide the breaking voltage, the durability of the contacts can be improved.

Since the contact region of the contact is formed of a material superior in welding resistance, the contacts can be cut off reliably with no welding of the contacts even if a large current flows at the time of short-circuiting.

By dividing the breaking voltage through a plurality of contact pairs and blowing away the arc by magnet 5 in the present invention, the arc voltage can be increased in a further shorter time to allow the relay to be cut off in a short time.

Since the arc energy is consumed by extending the arc through magnets 5 while dividing the voltage, it is not necessary to prepare a predetermined level of arc extension required for voltage cutoff Furthermore, the magnetic force of the magnet used can be reduced than in the conventional case, so that the magnet can be reduced in size.

When a backward current such as of regenerative energy flows in the relay, the arc will be extended towards a counter contact region, resulting in the problem that the arc will be linked.

However, in the direct current relay of the present embodiment, arc 100 extends in a direction crossing the contact aligning direction, alternately different. Therefore, even if a backward current such as regenerative energy is generated, the arc will be extended in a direction crossing the contact aligning direction. Therefore, the arcs will not be linked even when a backward current is generated. Thus, a backward current can be accommodated sufficiently.

When a solenoid, for example, is employed in the relay, an effective space set forth before is achieved in a direction orthogonal to the contact aligning direction. This effective space can be used as the space for arc extension. Therefore, it is no longer necessary to provide additional space for arcing.

In the present embodiment, an insulator 11 is provided between input contact 21 and intermediate contact 23, and between output contact 22 and intermediate contact 23, as shown in FIGS. 9 and 10. Insulator 11 is formed in sheet form at a portion of casing 1. By insulator 11, insulation between adjacent contacts is effected during contact establishment.

Although one of the contacts is set as a stationary contact in the present embodiment, both contacts may be movable contacts.

With regards to the direct current relay of a configuration according to the above-described first embodiment, direct relays were produced with the contact region of respective contacts formed of Ag alloy of the two types of chemical compositions for the first and second layers indicated in the "chemical composition" column shown in Table 1. The welding resistance and temperature characteristic were examined based on these produced direct current relays.

As to the Ag alloy, ingots were formed by molten casting the Ag alloy having the two chemical compositions for the first and second layers. These ingots were roughly worked. Then, the ingots of the first layer and the second layer were overlaid, and subjected to hot pressing by hot rolling at 850° C. in an argon ambient to produce a composite material formed of two layers of Ag alloy.

The obtained composite material was preheated under conditions identical to those of hot pressing. Then, a thin pure Ag sheet was attached to the face of the second layer opposite to the first layer by hot pressing such that it has a thickness 1/10 the eventual entire thickness. Cold rolling was further applied to result in a hoop-like material. The material was subjected to punching, whereby a composite contact chip of two structures, i.e., a structure 1 having a width, length and thickness of 6 mm, 8 mm and 2.5 mm, respectively, and a structure 2 having a width, length, and thickness of 6 mm, 6 mm, and 2 mm, respectively.

The obtained chip was maintained (internal oxidation) for 170 hours at 750° C. in an oxygen ambient of 4 atmospheres (405.3 kPa) to be employed as a composite contact specimen. The obtained specimen had a first layer of a thickness as shown in Table 1. The thickness of the Ag layer was approximately 1/10 the thickness of each chip.

The aforementioned thickness of the first layer can be confirmed, as set forth below, using the cross section of a specimen perpendicular to the surface, passing through the center of the contact. First, 5 starting points are set evenly spaced with each other in a direction horizontal to the surface on a specimen plane in the proximity of the surface. The hardness was confirmed at sequentially even intervals from the surface in a direction perpendicular to the surface (thickness direction) from respective points. Five curves of the hardness (line graph) were produced.

The crossing point of a horizontal line corresponding to the hardness level of 190 of a certain starting point and the aforementioned curve is taken, and the horizontal distance from the surface to this crossing point is set as the thickness of the first layer at that starting point. Similarly, the thickness of the first layer at a relevant starting point for all the remaining 4 starting points can be taken to set the arithmetical average value of the five obtained data as the thickness of the first layer. The thickness of the second layer can be measured in a similar manner.

In this context, the crossing point with a horizontal line corresponding to a hardness level of 130 is taken, and the horizontal distance from the surface to this crossing point can be set as the thickness of the second layer. In the case where an intermediate layer is provided, the horizontal distance between the crossing point with a horizontal line corresponding to a hardness level of 190 and the crossing point with a horizontal line corresponding to a hardness level of 130 can be taken as the thickness of the intermediate layer at a certain starting point. In the present example, the thickness of the first layer was measured by the procedure set forth above.

TABLE 1

| Specimen | Chemical Structure (mass %) | | | | | | Average Hardness (Hm V) | | Thickness of First |
|---|---|---|---|---|---|---|---|---|---|
| | First Layer | | | Second Layer | | | First | Second | Layer |
| No. | Sn | In | Misc. | Sn | In | Misc. | Layer | Layer | (μm) |
| *1 | 0.8 | 0.9 | — | 0.6 | 0.7 | — | 170 | 59 | 50 |
| 2 | 1.2 | 1.2 | — | 1.2 | 1.2 | — | 192 | 65 | 50 |
| 3 | 2.3 | 2.2 | — | 2.2 | 2.1 | — | 195 | 70 | 50 |
| 4 | 2.3 | 9.0 | — | 2.2 | 2.1 | — | 193 | 79 | 50 |
| 5 | 9.0 | 3.1 | — | 2.2 | 2.1 | — | 250 | 125 | 50 |
| 6 | 3.4 | 3.4 | — | 3.2 | 3.1 | — | 240 | 110 | 50 |
| 7 | 5.0 | 5.0 | — | 5.0 | 5.0 | — | 280 | 112 | 50 |

TABLE 1-continued

| Specimen | Chemical Structure (mass %) | | | | | | Average Hardness (Hm V) | | Thickness of First |
|---|---|---|---|---|---|---|---|---|---|
| | First Layer | | | Second Layer | | | First | Second | Layer |
| No. | Sn | In | Misc. | Sn | In | Misc. | Layer | Layer | (μm) |
| 8 | 7.0 | 7.0 | — | 7.0 | 7.0 | — | 290 | 125 | 50 |
| 9 | 8.0 | 7.5 | — | 7.8 | 7.2 | — | 302 | 127 | 50 |
| *10 | 9.2 | 9.2 | — | 9.1 | 9.1 | — | 310 | 134 | 50 |
| 11 | 1.2 | 1.2 | Sb | 1.2 | 1.2 | Sb | 200 | 75 | 50 |
| 12 | 2.3 | 2.2 | Sb | 2.2 | 2.1 | Sb | 220 | 69 | 50 |
| 13 | 2.3 | 9.0 | Sb | 2.2 | 2.1 | Sb | 200 | 70 | 50 |
| 14 | 9.0 | 3.1 | Sb | 2.2 | 2.1 | Sb | 260 | 128 | 50 |
| 15 | 3.4 | 3.4 | Ni | 3.2 | 3.1 | Ni | 250 | 115 | 50 |
| 16 | 5.0 | 5.0 | Ni | 5.0 | 5.0 | Ni | 293 | 115 | 50 |
| 17 | 9.0 | 9.0 | Bi | 9.0 | 8.9 | Bi | 300 | 128 | 50 |
| *18 | 9.2 | 9.2 | Bi | 9.1 | 9.1 | Bi | 320 | 139 | 50 |
| *19 | 5.0 | 5.0 | Sb et al. | 5.0 | 5.0 | Sb et al. | 300 | 116 | 9 |
| 20 | 5.0 | 5.0 | Sb et al. | 5.0 | 5.0 | Sb et al. | 287 | 114 | 11 |
| 21 | 5.0 | 5.0 | Sb et al. | 5.0 | 5.0 | Sb et al. | 286 | 110 | 26 |
| 22 | 5.0 | 5.0 | Sb et al. | 5.0 | 5.0 | Sb et al. | 286 | 110 | 32 |
| 23 | 5.0 | 5.0 | Sb et al. | 5.0 | 5.0 | Sb et al. | 286 | 110 | 70 |
| 24 | 5.0 | 5.0 | Sb et al. | 5.0 | 5.0 | Sb et al. | 286 | 110 | 120 |
| 25 | 5.0 | 5.0 | Sb et al. | 5.0 | 5.0 | Sb et al. | 286 | 110 | 260 |
| 26 | 5.0 | 5.0 | Sb et al. | 5.0 | 5.0 | Sb et al. | 286 | 110 | 350 |
| *27 | 5.0 | 5.0 | Sb et al. | 5.0 | 5.0 | Sb et al. | 286 | 110 | 370 |
| 28 | 5.0 | 5.0 | Sb et al. | 5.0 | 5.0 | Sb et al. | 282 | 113 | 50 |
| 29 | 5.0 | 5.0 | Sb et al. | 5.0 | 5.0 | Sb et al. | 285 | 102 | 50 |
| 30 | 4.0 | 3.0 | Ni et al. | 4.0 | 3.0 | Ni et al. | 270 | 100 | 50 |
| *31 | 4.0 | 3.0 | Ni et al. | 4.0 | 3.0 | Ni et al. | 170 | 100 | 50 |
| *32 | 4.0 | 3.0 | Ni et al. | 4.0 | 3.0 | Ni et al. | 270 | 132 | 50 |
| 33 | 7.0 | 7.0 | — | 7.0 | 7.0 | — | 290 | 125 | 50 |
| 34 | 7.0 | 7.0 | — | 7.0 | 7.0 | — | 293 | 128 | 50 |
| *35 | 4.0 | 7.0 | | 7.0 | 7.0 | | 136 | 180 | 50 |
| *36 | 3.4 | 3.4 | — | — | 3.1 | — | 150 | 68 | 200 |

The specimen in the table that has the symbol * assigned to each number indicates a comparison example. The amount of each of miscellaneous components Sb, Ni and Bi of Specimens 11–18 was 0.2 mass %. The first and second layers of Specimens 19–27 all have the same chemical structure, and the amount of miscellaneous components therein was 0.2 for each of Sb, Co, and Zn in mass % unit for both layers.

The miscellaneous components and amount thereof in Specimen 28 was 0.1 for Sb, Pb, Ni, Bi, Co, and Zn, and 0.2 for Ca in mass % unit. The miscellaneous components and amount in Specimen 29 was 0.1 for Sb, Ni, Ca, Bi, Co and Zn, and 0.5 for Pb in mass % unit. The miscellaneous components and amount in Specimens 30–32 were 0.2 in mass % unit for Ni and Zn. The remainder of the chemical composition of the first and second layers other than the components cited in the table include Ag and inevitable impurities.

Specimens 1–10 in Table 1 correspond to a group of specimens having the hardness of each layer controlled by altering the amount of Sn and In. Specimens 11–18 correspond to a group of specimens having the amount of Sn and In altered, and further added with miscellaneous components other than the above-cited elements. Specimens 19–27 correspond to a group of specimens having the thickness of the first layer altered.

Specimens 28–34 have the same chemical composition for both the first and second layers. Among these specimens, the hardness of the first layer was controlled as set forth below. Specimens 28–33 had the rolling working cross section area ratio of the first layer set to 150% of the second layer, and the material was subjected to annealing for 30 minutes at 450° C. in vacuum during the rolling working process of the first layer material. Then, following internal oxidation, shot blasting was applied for 3 minutes at the projecting pressure of 3 kgf/cm$^2$ (294 kPa) onto the surface of the first layer using alumina beads of #120.

Specimen 34 was produced under conditions similar to those of the specimen set forth above, provided that the annealing temperature and period of time during the rolling working process was 750° C. and 5 hours, respectively. Although not indicated in Table 1, Specimens 33 and 34 had an intermediate region of 190 μm and 230 μm, respectively, in thickness, formed therein.

Specimen 35 had the oxide amount of Sn and In in the first layer set lower than those of the second layer to achieve a hardness of the first layer lower than the hardness of the second layer. The Ag alloy of the first and second layers corresponding to chemical compositions cited in Table 1 was subjected to molten casting, hot pressing and rolling, and then subjected to internal oxidation under conditions identical to those set forth above.

Specimen 36 had the Ag alloy of the first and second layers with the chemical structure cited in Table 1 subjected to molten casting. Then, the matching faces of the two layers were worked to have recesses of 1 mm in width and 0.5 mm in thickness formed at the pitch of 1 mm in one horizontal direction. The matching faces were hot-pressed with respective recesses and projections engaging each other, followed by rolling. Then, the same was subjected to internal oxidation under conditions identical to those set forth above.

The thickness of the first layer having respective hardness of the specimens produced as described above was confirmed by a procedure set forth in the foregoing. All the results are shown in Table 1. Although not indicated in the table, the thickness of the intermediate region in the specimens other than Specimens 33 and 34 was all less than 100 μm.

The electrical contact chip of structure 1 and the electrical contact chip of structure 2 were attached by silver soldering to the main body of the movable contact shown in FIG. 1 and the main body of the stationary contact shown in FIG. 1, respectively, resulting in a contact region. Then, the contact region was secured to two types of direct current relays, i.e. a first frame of an AC rating of 30 A and a second frame of an AC rating of 50 A. Five of each type of such direct current relays were prepared for every composite contact chip pair of respective specimen numbers. Using the entire assembly of each specimen, a rated current was applied for 100 minutes to confirm the initial temperature characteristic by measuring the temperature during the current application.

Then, under a state of 220V load, cutoff testing was conducted using the assembly of each one at the cutoff current of 1.5 kA for the 30 A frame and a cut off current of 5 kA for the 50 A frame to confirm the welding resistance.

The temperature characteristic subsequent to the cutoff testing was confirmed by applying a rated current for 100 minutes subsequently to measure the temperature during this application. Excessive load testing was carried out using assemblies with their initial temperature characteristic confirmed, repeating opening and closure for 50 times at an interval of 5 seconds with a current five times the same rated current applied to both the 30 A frame and 50 A frame. Then, the temperature during application was measured under conditions identical to those for the above-described initial confirmation. Thus, the temperature characteristic subsequent to excessive load testing was confirmed.

Durability testing was conducted using assemblies having the initial temperature characteristic confirmed, repeating opening and closure for 6,000 times at an interval of 5 seconds with the same rated current conducted for both the 30 A frame and 50 A frame. Then, by measuring the temperature during application under conditions identical to those for the above-described initial confirmation, the temperature characteristic subsequent to durability testing was confirmed.

The evaluation for this series of testing was set in 5 stages, with the result of each type of the 30 A and 50 A frame integrated for the temperature characteristic. With regards to welding resistance, evaluation was based on whether welding occurred or not.

The five stages of evaluation for the temperature characteristic was 5 for a temperature increase of 50° C. or less, 4 for a temperature increase of more than 50° C. and not more than 60° C., 3 for a temperature increase of more than 60° C. and not more than 70° C., 2 for a temperature increase of more than 70° C. and not more than 80° C., and 1 for a temperature increase of 80° C. or above. These evaluations are shown in Table 2 corresponding to the specimen numbers in Table 1. In Table 2, the specimen number with * implies a comparison example.

TABLE 2

| | Result of Electric Testing | | | | |
|---|---|---|---|---|---|
| Specimen No. | Welding Resistance | Initial Temperature Characteristic | Temperature Characteristic After Excessive Load Testing | Temperature Characteristic After Durability Testing | Temperature Characteristic After Cutoff Testing |
| *1 | x | 5 | 2 | 2 | 1 |
| 2 | ○ | 5 | 3 | 3 | 3 |
| 3 | ○ | 5 | 4 | 3 | 3 |
| 4 | ○ | 5 | 3 | 3 | 3 |
| 5 | ○ | 3 | 3 | 4 | 3 |
| 6 | ○ | 4 | 4 | 4 | 4 |
| 7 | ○ | 3 | 4 | 4 | 3 |
| 8 | ○ | 3 | 4 | 4 | 3 |
| 9 | ○ | 3 | 3 | 3 | 3 |
| *10 | ○ | 2 | 1 | 2 | 1 |
| 11 | ○ | 4 | 3 | 3 | 3 |
| 12 | ○ | 4 | 3 | 4 | 4 |
| 13 | ○ | 4 | 3 | 3 | 3 |
| 14 | ○ | 3 | 3 | 3 | 3 |
| 15 | ○ | 4 | 4 | 4 | 4 |
| 16 | ○ | 3 | 4 | 4 | 3 |
| 17 | ○ | 3 | 3 | 4 | 3 |
| *18 | ○ | 3 | 2 | 3 | 2 |
| *19 | x | 3 | 3 | 2 | 3 |
| 20 | ○ | 4 | 3 | 3 | 3 |
| 21 | ○ | 4 | 3 | 3 | 4 |
| 22 | ○ | 4 | 3 | 4 | 4 |
| 23 | ○ | 4 | 4 | 4 | 4 |
| 24 | ○ | 4 | 4 | 4 | 4 |
| 25 | ○ | 4 | 4 | 3 | 4 |
| 26 | ○ | 3 | 4 | 3 | 4 |
| *27 | x | 2 | 4 | 3 | 4 |
| 28 | ○ | 3 | 4 | 4 | 3 |
| 29 | ○ | 3 | 4 | 4 | 3 |
| 30 | ○ | 4 | 4 | 4 | 4 |
| *31 | x | 5 | 2 | 2 | 2 |
| *32 | x | 4 | 2 | 4 | 2 |

TABLE 2-continued

| Specimen No. | Welding Resistance | Initial Temperature Characteristic | Temperature Characteristic After Excessive Load Testing | Temperature Characteristic After Durability Testing | Temperature Characteristic After Cutoff Testing |
|---|---|---|---|---|---|
| | Result of Electric Testing | | | | |
| 33 | ○ | 3 | 4 | 4 | 3 |
| 34 | ○ | 3 | 4 | 3 | 3 |
| *35 | x | 4 | 2 | 2 | 2 |
| *36 | x | 5 | 1 | 2 | 1 |

In view of the foregoing results, the following was identified:

(1) A relay employing the contact of the present invention having the Sn and In controlled to be within the range of 1–9 mass % for both the first and second layers, having the micro Vickers hardness of the first and second layers set to at least 190 and not more than 130, respectively, and having the thickness of the first layer controlled to be within the range of 10–360 μm is within the range of sufficient usage applicability based on the integrated evaluation set forth above. In contrast, relays employing a contact departing from the scope of the present invention do not achieve the level of usage application based on the integrated evaluation.

(2) The same applies to the case where a small amount of component such as Sb and/or Ni is added in addition to Sn and In.

(3) The contact chip of Specimen 1, Specimen 10, Specimen 18, Specimen 31, Specimen 32, Specimen 35 and Specimen 36 corresponding to comparative examples depart from the scope of the present invention in hardness level. Direct current relays incorporating such contact chips did not achieve the performance of usage application level on an integrated basis with the exception of some of the property.

INDUSTRIAL APPLICABILITY

Since the relay of the present invention is compact, limited space can be used effectively when employed as a relay to turn ON/OFF a high voltage circuit in an automobile of high voltage (approximately 300V) such as a hybrid vehicle.

The invention claimed is:

1. A direct current relay comprising:

a plurality of contact pairs, and a plurality of magnets, wherein each of said plurality of contact pairs includes contacts having contact regions, said contacts configured to allow opening and closure with respect to each other, said plurality of contact pairs are arranged such that said plurality of magnets are aligned on one straight line, and said contact pair is located between said magnets on a line identical to said straight line, each of said plurality of magnets is provided so as to distort an arc generated between said contacts on an occasion of relay cutoff in a direction crossing said straight line, a contact area of said contact region has a shape such that a length of the contact area in a direction of said straight line is shorter than a length in a direction orthogonal to said straight line.

2. The direct current relay according to claim 1, wherein said contact pairs are arranged respectively so that they can be connected in series.

3. The direct current relay according to claim 2, wherein said contact includes an input contact, an output contact, at least one intermediate contact disposed between said input contact and said output contact, and having two contact regions, and a plurality of linking contacts connecting in series said input contact, said intermediate contact and said output contact sequentially in a conducting state, said input contact, said output contact and said intermediate contact being disposed at one side of a switching direction of said contact, and said linking contact being disposed at the other side of the switching direction of said contact.

4. The direct current relay according to claim 1, wherein said contact pairs are arranged respectively so that they can be connected in parallel.

5. The direct current relay according to claim 1, wherein said contact region is formed of Ag alloy of a chemical composition including 1–9 mass % of Sn and 1–9 mass % of In, said contact region including a first layer at a surface region and a second layer at an inner region, said first layer having a micro Vickers hardness of at least 190, and said second layer having a micro Vickers hardness of not more than 130, and said first layer has a thickness in a range of 10–360 μm.

* * * * *